United States Patent [19]

Arai et al.

[11] 4,167,847

[45] Sep. 18, 1979

[54] BULKY YARN AND METHOD FOR PRODUCING THE SAME

[75] Inventors: Hajime Arai; Yoshiaki Sato; Kiyoshi Nakagawa, all of Mishima, Japan

[73] Assignee: Toray Industries, Inc., Tokyo, Japan

[21] Appl. No.: 878,171

[22] Filed: Feb. 15, 1978

[30] Foreign Application Priority Data

Feb. 23, 1977 [JP] Japan ..... 52-18157

[51] Int. Cl.[2] ..... D02G 3/04; D02G 3/24; D02G 3/34

[52] U.S. Cl. ..... 57/244; 57/208; 57/246

[58] Field of Search ..... 57/140 R, 140 BY, 140 J, 57/206, 208, 244, 246

[56] References Cited

U.S. PATENT DOCUMENTS

| | | | |
|---|---|---|---|
| 3,593,513 | 7/1971 | Reese | 57/140 BY |
| 3,622,264 | 11/1971 | Brown et al. | 57/140 BY X |
| 3,652,198 | 3/1972 | Farber et al. | 57/140 BY X |
| 3,846,970 | 11/1974 | Hitomi et al. | 57/140 R |
| 3,852,948 | 12/1974 | Ruddell et al. | 57/140 R |

*Primary Examiner*—Charles Gorenstein
*Attorney, Agent, or Firm*—Miller & Prestia

[57] ABSTRACT

Disclosed is a bulky yarn made from a thermoplastic multifilament yarn. Each of the individual filaments forming the yarn has a randomly varying thermal shrinkage along its length. The filaments in the cross-section of the yarn also have randomly varying thermal shrinkages. The bulky yarn forms a plurality of loops having a stable and compact configuration, while the number of filament slack portions which project outwardly from the yarn surface is significantly decreased.

A method for producing a bulky yarn possessing the above-mentioned construction is also disclosed. In the method, individual filaments forming the multifilament yarn are interlaced with each other, before or after which the yarn is subjected to a so-called random heat treatment. The interlaced and randomly heat-treated yarn is supplied at an over-feed condition to a fluid turbulent flow region which causes the individual filaments to form a plurality of loops and entanglements, and then the yarn is wound onto a package.

6 Claims, 9 Drawing Figures

BULKY YARN AND METHOD FOR PRODUCING THE SAME

DESCRIPTION OF THE INVENTION

The present invention relates to a bulky yarn made of a thermoplastic multifilament yarn having loops and entanglements of individual filaments with each other, and also relates to a method for producing such a bulky yarn.

The technique of producing a bulky yarn from a multifilament yarn wherein the multifilament yarn is subjected to the action of a fluid turbulent flow for forming loops and entanglements of individual filaments with each other is quite well known.

Also known in the art is a technique by which the bulkiness of the bulky yarn provided with the loops and entanglements is increased for producing fabrics of a superior bulkiness and softness, as is disclosed in Japanese Laid-Open Patent Publication No. 50-89659.

In the method of this Patent Publication No. 50-89659 a continuously moving thermoplastic multifilament yarn is brought into contact, under a tension lower than a thermal shrinkage stress, with a heated body so that crimps, different thermal shrinkage and differential filament lengths are located randomly along the length thereof. Thereafter the yarn is passed through a fluid turbulent flow region for interlacing the crimps and loops together with each of filaments, and then the yarn is wound onto a package. Thus, a spun-like textured filament yarn is obtained which possesses a superior bulk after being subjected to heat treatment. The bulky yarn has high bulk when compared with that of the bulky yarn produced by subjecting the yarn only to the action of a fluid turbulent flow. However, the bulky yarn obtained by using the method of Japanese Laid-Open Patent Publication No. 50-89659 is disadvantageous in that the yarn has a plurality of slack portions which project outwardly from the surface of the yarn. These slack portions prevent the yarn from being easily unwound from the package. Such slack portions tend to become entangled with each other during subsequent processes such as knitting or weaving, thus causing the individual filaments to be frequently broken. These slack portions also tend to become entangled with knitting needles, thus decreasing fabric productivity.

An object of the present invention is to provide a bulky yarn which overcomes the above-mentioned drawbacks in the prior art.

Another object of the present invention is to provide a bulky yarn made of a thermoplastic multifilament yarn having a spun-like touch and appearance.

Still another object of the present invention is to provide a bulky yarn which can be easily unwound from a package and used in a highly productive fabric-making process.

A further object of the present invention is to provide a method for effectively producing the above-mentioned bulky yarn.

According to one aspect of the present invention, a bulky yarn made of a thermoplastic multifilament yarn is provided, which yarn includes a plurality of individual filaments, each of the filaments having a randomly varying thermal shrinkage along its length, the filaments in a cross-section of the yarn having randomly varying thermal shrinkage. The number of loops per meter which project from the surface of the bundle of the filaments is higher than 3000, and the number of slack portions per meter of filament (or filaments), which are projected from the surface of a bundle of filaments and which have a maximum spacing from the surface that is greater than 2.5 mm, is less than 0.8 slack portions per meter.

According to another aspect of the present invention, a method for producing a bulky yarn of a thermoplastic multifilament yarn is provided, such method comprising the steps of:

(a) contacting a multifilament yarn, which is continuously moving, under low tension with a heated body so that the individual filaments have, along the length thereof, randomly varying values of thermal shrinkage, differential lengths of individual filaments and randomly arranged loosened arch-shaped portions, (b) interlacing the moving individual filaments with each other by projecting a fluid toward the moving yarn, before or after the yarn is subjected to contact with a heated body, (c) supplying the interlaced filaments, at an overfeed rate equal to or greater than 10%, to a region where turbulent flow is created by the injection of a fluid whose pressure is equal to or greater than 3.0 $Kg/cm^2$ (gauge), in order to cause the filaments to form loops and entanglements, and;

(d) taking up the yarn a package.

The present invention will now be described with reference to the accompanying drawings in which.

Figure 1A:
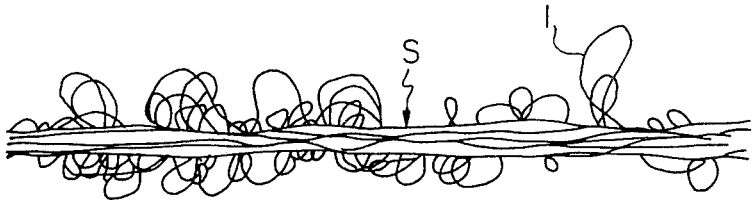
FIG. 1A is an enlarged view of a bulky yarn according to the present invention.

Referring to FIG. 1A, a bulky yarn according to the present invention is made of a thermoplastic multifilament yarn comprising individual filaments entangled with each other and defining a plurality of loops 1 projected from the surface S of a bundle of filaments.

Figure 1B:
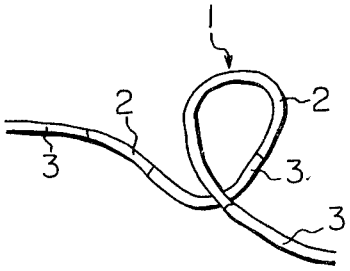
FIG. 1B is an enlarged view of an individual filament of the bulky yarn shown in FIG. 1A.

Referring to FIG. 1B showing an enlarged view of an individual filament of the yarn shown in FIG. 1A, an individual filament defining a loop 1 is comprised of portions 2 which have been substantially subjected to heat treatment and portions 3 which have not been substantially subjected to any heat treatment. It should be noted that the portions 2 and 3 have different values of thermal shrinkage, and that, at the region between each of the adjacent portions 2 and 3, the thermal shrinkage does not sharply change. Such portions 2 and 3 of differing lengths are alternately disposed along the entire length of the filament. The number of loops (loop number) per meter of the bulky yarn according to the present invention, measured by a method which will be described hereinafter, is greater than 3000.

Figure 1C:
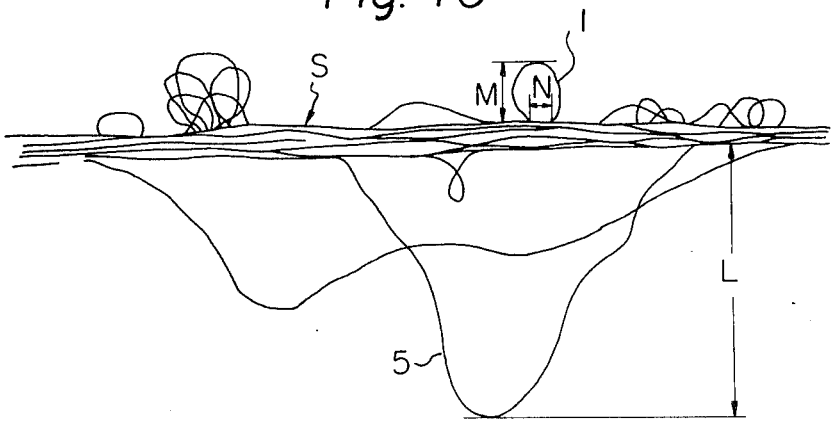
FIG. 1C is a view of a bulky yarn, this view being diagrammatic and used for illustrating the method for measuring the number of loops according to this invention.

Referring to FIG. 1C, the individual filaments also form slack portions 5 along the entire length of the filaments.

According to the present invention the total number of slack portions 5 per meter in the bulky yarn is limited to less than 0.8 slack portions perimeter. The method for measuring the number of slack portions (slack number) will be described hereinafter.

Furthermore, the bulky yarn according to the present invention is comprised of individual filaments, each of which filaments has varying values of thermal shrinkage along the length of the filament. Further the filaments located in a cross-section transverse to the length of the yarn have different values of thermal shrinkage. Therefore, the yarn of the present invention, or fabric formed therefrom, exhibits increased bulk after heat treatment. The degree of bulkiness of the bulky yarn is measured by a method which will be described hereinafter. The difference between the values of the degree of bulkiness before and after heat treatment should preferably be greater than 5 cc/g, and, more preferably, greater than 7 cc/g. The degree of bulkiness is preferably within the range of 6 cc/g to 15 cc/g, in order to provide the yarn with a larger number of loops per meter than 3000 and the touch and appearance of a spun-like yarn, as well as to permit the yarn to be easily unwound from a package and used in a subsequent process for making fabrics with a high degree of efficiency. The bulky yarn of the above-mentioned construction according to the present invention is produced by using the process and apparatus schematically shown in FIG. 2.

Figure 2:
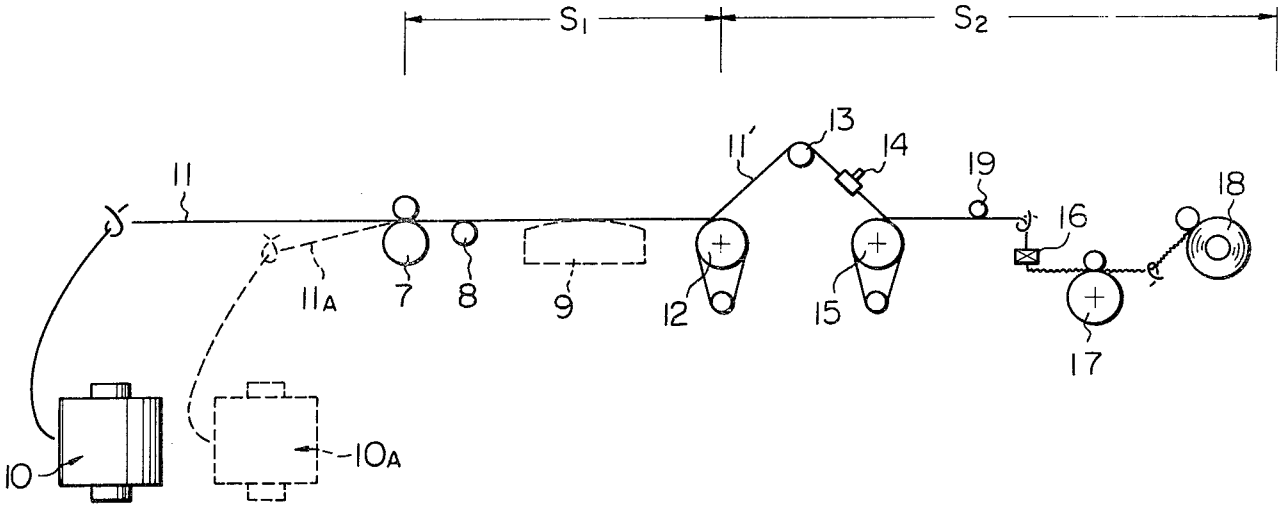
FIG. 2 is a schematic diagram of a device for producing the yarn of FIG. 1A.

The apparatus of FIG. 2 is comprised of a drawing station $S_1$ and a bulky process station $S_2$ which is directly connected to the station $S_1$. The drawing station $S_1$ has a pair of drawing rollers 7 and 12, between which a drawing or heated pin 8 is positioned. A heated plate 9, if desired, can be conveniently located between the heated pin 8 and the drawing roller 12. Of course the drawing method is not limited to the above-mentioned method; any of the well-known drawing methods, can be used. A thermoplastic undrawn multifilament yarn 11 from a package 10 is subjected to drawing between the rollers 7 and 12 to form a drawn yarn 11' supplied to the station $S_2$. Another undrawn yarn 11A of a type which is the same as or different from the yarn 11 can if desired, be supplied from a package 10A and introduced together with the yarn 11 into the drawing zone $S_1$ in order to form a combined type of drawn yarn.

The drawn yarn 11' introduced into the bulky process station $S_2$ is directed to a so-called random heat-treatment pin 13 and then to an interlacing device 14, which are both located between the roller 12 and another roller 15. The peripheral speed of the roller 15 which is different from that of the roller 12 is determined in such a manner that the yarn 11' has a low tension which is lower than the thermal shrinkage stress of the yarn (preferably in a range between 5 mg/d and 120 mg/d, or more preferably in a range between 10 mg/d to 60 mg/d). This low tension is present at the position of the heated pin 13 and serves for loosening the individual filaments. In such a manner the moving yarn is brought into contact with the heated pin 13 for a short period sufficient to enable the heat from the pin 13 to be non-uniformly conducted to various parts of the yarn. Contacting the moving yarn with the heated pin 13 produces different thermal shrinkages in differential lengths of filaments, and also causes the filament to form loosened arch-shaped portions. The yarn thus issued from the heated pin 13 is directed to the interlacing device 14, so that the individual filaments or groups of filaments of differential lengths, having loosened portions, are interlaced together or with bundles of filaments, thus causing the maximum spacing of the loosened portions from the surface of the bundle to be decreased.

The yarn from the roller 15 is directed to a so-called "Taslan" nozzle 16 (trademark of a product manufactured by the Du Pont Company which performs air jet texturing to produce bulky yarn) under an overfeed condition which is generated by the difference between the peripheral speed of a roller 17 and that of the roller 15. Thus, the yarn which passes through the jet texturing nozzle 16 is subjected to the action of a fluid turbulent flow, separating the individual filaments of the yarn from each other and forming randomly twisted portions in the filaments. When the yarn is discharged from the nozzle 16 and released from the turbulent flow region, the twisted portions are changed to loops. Thus, a bundle of filaments in a stabilized shape is obtained. Thereafter, the yarn from the roller 17 is wound onto a package by a take-up device 18.

The above-mentioned process should be controlled in such a manner that the produced bulky yarn forms a plurality of loops, wherein the number of loops (loop number) per meter of yarn is larger than 3,000, preferably larger than 4,000, and the number of slack portions per meter of a filament (or group of filaments), which has a maximum spacing from the surface S of the filament bundle which is greater than 2.5 mm, is smaller than 0.8, preferably smaller than 0.5 slack portions per meter. A yarn having a loop number lower than 3,000 per meter produces a knitted fabric that has insufficient bulkiness and inferior quality. A yarn having a "slack number" larger than 0.8 per meter is not only difficult to unwind from its package, but exhibits poor processability in a subsequent process such as knitting or weaving. It should be noted that the yarn produced by the previously mentioned method disclosed in the Japanese Laid-Open Publication No. 50-89659 has a "slack number" which is greater than 2 slack portions per meter.

Preferably, the undrawn yarn 11 is supplied to the device shown in FIG. 2 in which the bulking process is directly connected to the drawing process. However, a drawn yarn can be used for producing the bulky yarn according to the present invention. In the latter case, the drawn yarn is directly supplied to station $S_2$ shown in FIG. 2.

Although the interlacing device 14 can be disposed before the heated pin 13, it is preferable to dispose the device 14 after the heated pin 13 as shown in FIG. 2.

The yarn should be passed through the jet texturing nozzle 16 under an overfeed condition in order to produce a sufficiently large number of loops. In order to produce a number larger than 3,000 loops per meter, the peripheral speed of the roller 15 with respect to that of the roller 17 should be selected so that the overfeed ratio is equal to or greater than 10%, preferably in a ratio range of from 13% to 50%.

A well-known device of the compression air injection type, as disclosed in U.S. Pat. No. 3,110,151, can be conveniently utilized as the interlacing device 14. However, other types of interlacing devices can also be used.

Instead of the nozzle 16, well-known fluid turbulent flow nozzles, which are, for example, disclosed in U.S. Pat. Nos. 2,994,938 or 3,863,309, can be conveniently utilized. In order to maintain the number of slack portions less than 0.8 per meter in the bulky yarn, the pressure of the fluid supplied to the nozzle 16 should be equal to or greater than 3.0 kg/cm$^3$ (gauge). The pressure should more preferably be greater than 4.0 kg/cm$^2$, while the ratio of the pressure (kg/cm$^2$) to the square root of the speed (m/min) of the yarn directed to the turbulent flow region should be greater than 0.23.

Preferably, a device 19 (FIG. 2) can be disposed before the nozzle 16 for adding water to the yarn to enhance the effect of the process performed by the nozzle 16, which in turn increases the degree of loop stability as well as the uniformity of loops and entanglements.

The thermoplastic multifilament yarn includes those made from plastic polymers for example, polyamides, polyesters, and polyvinyls. The polyesters are, for example, those which have a dibasic acid component primarily comprised of terephthalic acid and a glycol component primarily comprised of ethylene glycol or cyclohexane dimethanol, or those which are derived from ethyleneoxy benzoate. The polyesters may be those obtained by copolymerizing various ester-forming compounds. The polyamides are, for example, those derived from polyepsiloncapramide or polyhexamethylene adipamide. The polyamides may be those obtained by copolymerizing various amide-forming compounds.

The multifilament yarn can include any known modifiers, such as pigments, antistatic components, fire retarding components, and components having an affinity for dyes. The shape of the cross-section of the yarn may be round or non-round.

A polyester yarn provided with the above-mentioned components having an affinity for dyes can be combined with another polyester yarn which does not include any such components. For example, an ionic undeyeable polyester multifilament $F_1$ can be combined with an ionic dyeable multifilament $F_2$ in such a manner that the ratio of the weights of the filaments $F_1$ and $F_2$ is within the range of from 1:4 to 4:1. Such a combined bulky yarn exhibits increased bulkiness and can be used in a subsequent fabric-making process with good productivity. The fabrics made from such combined bulky yarn can provide a uniformly mixed and sprinkled colored effect (heather effect) after being subjected to the dyeing process.

Preferably, the multifilament drawn yarn just before being brought into contact with the heated pin 13 under low tension should have a thermal shrinkage in boiling water of greater than 3% in order to provide sufficient bulkiness after heat treatment. The thermal shrinkage in boiling water should more preferably be greater than 5%. It is also preferable that at least two types of thermoplastic multifilament yarns which have a different thermal shrinkages in boiling water greater than 3% are supplied to the heated pin under low tension, since a bulky yarn of highly increased degree of bulkiness can be obtained after heat treatment.

In order to increase loop stability, it is preferable to use a multifilament composed of a larger number of fine denier filaments. It should be noted that the denier of an individual filament of the yarn should preferably be less than 3.2 d and more preferably less than 2.1 d. In addition, the total number of individual filaments should preferably be greater than 24.

In order to obtain a bulky yarn having very high loop stability, a multifilament yarn composed of individual filaments with a finer denier than 2.2 denier and another multifilament yarn composed of individual filaments with a heavier denier than 3.0 denier are used. In this case, the number of fine denier filaments is specially selected to be larger than one-half of the total number of filaments for producing a bulky yarn having an increased loop stability which is larger than 0.8 g/d.

It should also be appreciated that the bulky yarn according to the present invention can be used as a package dyeing yarn. In order to obtain such a package dyeing yarn, the bulky yarn is wound onto a soft package to allow the package to be directly subjected to a dyeing process, or a so-called dyeing tube is inserted into the package prior to the dyeing process. The above-mentioned soft package is obtained by winding the bulky yarn under a low tension equal to or less than 0.08 g/d by means of a take-up device 18 (FIG. 2) while the density of the package is kept equal to or lower than 0.30 g/cc. As a result, the dyes can uniformly penetrate to the inner portions of the package as well as to the outer portions of the package, and fluctuations in the tension of the yarn from the outer portions to the inner portions of the package as well as the number of end breakages can be minimized when the yarn is unwound from the package during a subsequent process.

Described hereinafter is a method for measuring the number of loops (loop number); the number of slack portions (slack number) of a filament or of a group of filaments; the thermal shrinkage in boiling water; the degree of bulkiness after heat treatment; the degree of bulkiness before heat treatment; the density of a package; loop stability; and overfeed ratio. In addition, determination the randomly changed thermal shrinkage of a filament in the longitudinal direction of a bulky yarn, as well as the randomly changed thermal shrinkage of filaments in a cross-section, will be described.

Method for Measuring Loop Number

A bulky yarn having a length of 5 to 10 cm is held between a pair of transparent flat plates under a tension of 0.1 g/d. The yarn held by the plate is magnified by an amplifier lens at a magnitude of 17. An example of such an image is shown in FIG. 1C. This example shows a yarn which was subjected to the process of the invention and which has individual filaments exhibiting loosened portions 1 and 5 which project outwardly from the surface S of the bundle of filaments. In each of the portions 1, a maximum spacing M from the surface S and a spacing N between the ends of the portion 1, from which the portion 1 is projected outwardly, are measured. Next, the value of N/M is calculated. A portion 1 of the filament having an N/M value equal to or less than 4 is herein referred to as a "loop". A portion 5 with an N/M value greater than 4 is referred to as an "arch". The number of loops 2 centimeters in length is measured. This measurement is carried out for twenty randomly sampled yarns. The average value of the thus measured values is calculated to obtain the number of loops (loop number) in one meter of yarn.

Method for Measuring Slack Number

In the present invention, the above-mentioned loosened portion 5 of a filament or of a group of filaments which has a maximum spacing L from the surface S greater than 2.5 mm is referred to as a slack portion. In this case, a group of filaments is defined as a plurality of individual filaments which are situated on the same position to form the same profile.

A bulky yarn ten meters in length is placed on a black sheet and observed by means of an amplifier lens, in order to measure the number of slack portions 5. This measurement is carried out for ten randomly sampled yarns. The average value of the thus measured values is calculated in order to obtain the number of slack portions (slack number) in one meter of one filament or of a group of filaments.

Shrinkage in Boiling Water

A multifilament yarn before being subjected to the bulking process of the invention is wound up on a reel having a peripheral diameter of 1 meter to form one hank of yarn which is comprised of ten windings. A length $L_1$ (not shown in the drawings) of the hank is measured under a load of 2 D grams, wherein D indicates the denier of the multifilament yarn. Secondly, the hank (not shown) of yarn is boiled for 15 minutes under no load, and then a length $L_2$ of the hank is measured under a load of 2 D grams. The shrinkage in boiling water is calculated from the following equation.

$$L_1 - L_2/L_1 \times 100(\%) \quad (1)$$

Degree of Bulkiness after Heat Treatment

Figure 3:
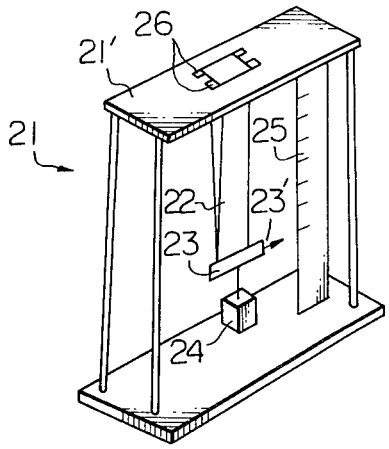
FIG. 3 is a perspective view of a device for measuring the degree of yarn bulkiness.
Figure 4A:
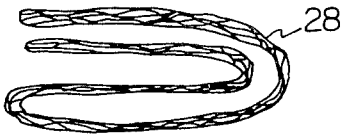
FIGS. 4A, 4B and 4C show the steps of measuring the degree of bulkiness, using the device shown in FIG. 3.
Figure 4B:
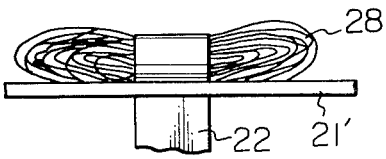
Figure 4C:
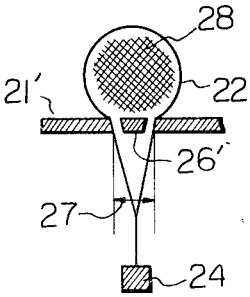

A perspective view of a device for measuring degree of bulkiness is shown in FIGS. 3, 4B and 4C. This device comprises a sample table 21 which has an upper wall 21' with a pair of spaced apart parallel openings 26 of a substantially rectangular cross-sectional shape and an engaging portion 26' (FIG. 4C) formed between the openings 26. The spacing 27 (FIG. 4C) between the outside edges of the openings 26 is selected to have a length of 6 mm. An upper end of an endless, flexible tape 26 (2.5 cm in width) made of a thin fabric is positioned to loop around the portion 26'. A member 23, which is provided with an indicator needle 23' and a weight 24, is secured to a lower end of the tape 26. The total weight of the member 28 including the members 23' and 24 is selected to be 50 grams. A scale 25 is positioned near the needle 23' in such a manner that the needle 23' indicates zero (cm) when no sample is placed on the table 21.

Samples in the form of hanks each having 80 windings are prepared from bulky yarn of the present invention by using a reel which has a peripheral diameter of 1 meter. The number of hanks to be prepared should be between 2 and 10 in accordance with the yarn's denier number as is described below. The hanks which are hung in a no load condition are subjected to heat treatment in the atmosphere at a temperature of 200° C.±5° C. for 5 minutes. Next, the heat-treated hanks are bundled together in parallel so that the total denier is equal to 48,000. (For example, when a yarn of 30 denier is used, 10 hanks are required; therefore, the total denier of the hanks is equal to 10(hanks)×30(denier)×80(windings)×2, the product of which is 48,000. When a yarn of 75 denier is used, 4 hanks are required; therefore, the total denier, in this case, is equal to 4(hanks)×75(denier)×80(windings)×2, the product of which is 48,000.) The parallel bundled hanks are folded into four parts as shown in FIG. 4A to form a sample 28. The sample 28 is inserted between the tape 22 and the upper wall 21' as shown by FIGS. 4B and 4C. As a result, the position of the indicator needle 23' is raised with respect to the zero point. A value (L) corresponding to this increase is measured by using the above-mentioned scale 25. Three different values (L) are measured by changing the position of the sample 28 at three different times. Next, a mean value $\bar{L}$ of the values L is calculated. The bulk factor M is calculated from the following equation:

$$M(\text{cc/g}) = \frac{\text{Volume of the yarn}(V)}{\text{Weight of the yarn}(W)} \quad (2)$$

$$V = \frac{\bar{L}^2}{\pi} \times 2.5 \quad (3)$$

$$W = D \times \frac{100}{100 - SH} \times P \times 0.025 \times \frac{1}{9000} \quad (4)$$

wherein D is the denier of the yarn before heat treatment; P is the number of the filaments in the yarn; and SH is the shrinkage (%) in dry heat, which is obtained by measuring, before and after the heat treatment, the lengths of the hanks (prepared as described above) under a load of 4 mg/d.

Degree of Bulkiness Before Heat Treatment

This method for determining the degree of bulkiness is the same as the measurement of the degree of bulkiness after heat treatment, except that no heat treatment is carried out, and that a value of SH in equation (4) is zero.

Density of Package

The density (g/cc) of a package made from the bulky yarn is expressed as a ratio of the weight (g) of the package to the volume (cc) of the package.

Loop Stability

Figure 5:
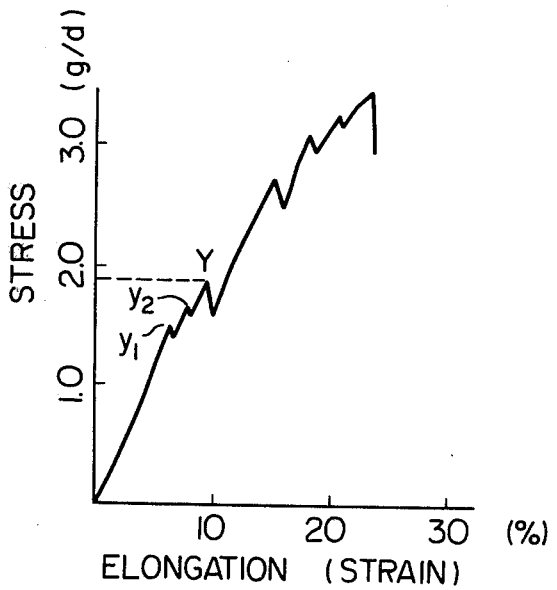
FIG. 5 is a typical stress-strain curve of the bulky yarn of the present invention, which curve is used for determining loop stability.

In the stress-strain curve (FIG. 5) of a sample, the point of the curve where an instantaneous local decrease of stress (g/d) occurs, which decrease is more than 10% of the stress at this point, is referred to as a "yield point". The initial value of the stress, at which the instantaneous decrease at the yield point begins, is referred to as "loop stability". For example, the stress-strain curve of the sample shown in FIG. 5 shows that the loop stability is 1.75 g/d, and the yield point is designated by the letter Y. In the curve of FIG. 5, the stress did locally decrease at points $y_1$ and $y_2$ before the stress was increased to the yield point Y. Such points $y_1$ and $y_2$ are not yield points, since the values of the local stress decreases at these points $y_1$ and $y_2$ are less than the stress at that point. It should be noted that a relatively higher value of stress (g/d) at the yield point is preferable. Most preferably, the stress-strain curve should conform substantially to a smooth curve; in which case, the yield point conforms to the breaking point on the stress-strain curve.

The stress-strain curve is obtained from the results of a tensile tester of the so-called "Instron type", in which the length of each sample is 20 cm, the rate of stretching is 10 cm/min, and in which the curve is recorded on a sheet of paper. Three curves are obtained from one sample, and data obtained from these curves are averaged. As the denier for calculating the yield stress, the denier of the yarn at a position before encountering the Taslan nozzle 16 is used, since the yarn subjected to the texturing process of the invention may have varying bulkiness depending upon the operating conditions at the station $S_2$ (FIG. 2).

Overfeed Ratio

The overfeed ratio is calculated from the following equation:

$$V_1 - V_2/V_2 \times 100(\%) \quad (5)$$

wherein $V_1$ is the peripheral speed of the roller 15 and $V_2$ is the peripheral speed of the roller 17.

Definition of Randomly Varying Shrinkage of a Single Filament of a Bulky Yarn Along the Length of the Filament A single filament is carefully separated from a bulky yarn sample so that the tension generated in the filament is as low as possible. From the separated single filament 50 pieces each about 3 cm in length are obtained. One end of each piece is held by a clip while a weight of 0.1 g /d is suspended from the other end of the piece so that the length $FL_1$ between the clip and the weight is in a range of from 2 to 2.5 cm. The value ($FL_1$) of each piece is measured by a so-called travelling microscope. Thereafter, each filament piece is subjected to heat treatment at 200° C. for 5 minutes while the portion of the filament located between the clip and the weight is in a sufficiently loosened condition so as to allow the portion to be fully shrunk during the heat treatment. Then, the length ($FL_2$) of each of the filament pieces located between the clip and the weight of 0.1 g/d in a freely suspended condition is measured by using the microscope. The value of shrinkage in a dry heat condition of each filament piece is calculated by means of the following equation.

$$FL_1-FL_2/FL_1\times 100 \quad (6)$$

The shrinkage value is calculated for pieces obtained from the separated filament samples. Thereafter, a curve indicating the relationships between specified shrinkage value and the number of pieces having the specified value, or a so-called histogram, is prepared. If this curve has a distributed pattern and the difference between the maximum value of shrinkage and the minimum value of shrinkage is greater than a value of 4%, the filament is described as having randomly varying thermal shrinkage along the length of the filament.

Definition of Randomly Varying Thermal Shrinkage of Filaments across the Cross-Section of the Yarn A sample of bulky yarn is cut at a desired position to a length of about 3 cm. Each of the filaments having such a length is carefully separated from the others, with the tension applied to the filaments being as low as possible. Next, values of shrinkage in dry heat of all of the separated filaments are calculated by using the above-mentioned method and equation (6). Then a histogram, that is, a curve indicating the relationship between the specified value of shrinkage in the dry heat condition and the number of pieces exhibiting this specified value, is provided. Then, measurements similar to those described hereinbefore are carried out for ten samples of the same yarn, in order to obtain an average value of the difference between the maximum coefficient value and the minimum coefficient value. If the histogram curve has a distributed pattern and the average value of the difference between the maximum coefficient value and the minimum coefficient value is greater than a coefficient value of 4%, the yarn is described as having randomly varying shrinkage across the cross-section of the yarn.

When a plurality of peaks appear in the histogram curve of 1% step of the coefficient of shrinkage, the average value ($X_A$) of the differences between the shrinkage value of the highest peak and the shrinkage value of the next peak is calculated for the ten samples obtained from the same yarn. Then, an average value $X_B$ of the differences between the maximum shrinkage value and the minimum shrinkage value is calculated for ten samples from the same yarn. If $X_B-X_A$ is greater than 4%, the filament is described as having a randomly changed thermal shrinkage across the cross-section of the yarn.

The present invention is now described with reference to the following Examples.

EXAMPLE 1

An undrawn multifilament polyester (polyethylene terephthalate) yarn 11 was treated by means of the device shown in FIG. 2, wherein the drawing ratio between the rollers 7 and 12 was 3.2. The temperature of the drawing pin 8 and the temperature of the heated plate were 95° C. and 110° C., respectively. Accordingly, a drawn yarn of 150 denier, having 72 filaments and a shrinkage of 12% in boiling water was obtained at the output of the station $S_1$. The produced drawn yarn 11' was next introduced into the station $S_2$. The peripheral speeds of the rollers 12 and 15 were 200 m/min and 185 m/min, respectively. The heated pin 13 with a diameter of 35 mm and of a temperature of 220° C. was used. The interlacing device 14 for ejecting compressed air is of a well-known type nozle which has a yarn passageway diameter of 1.5 mm, a length of 15 mm, and a compressed air ejecting hole of 1.0 mm in diameter. A compressed air pressure of 3.0 kg/cm$^2$ is directed to the interlacing device 14. The yarn tension occurring between the interlacing device 14 and the heated pin 13 was 30 mg/d.

The construction of the Taslan nozzle 16 was the same as that disclosed in FIG. 4 in U.S. Pat. No. 3,545,057. The air pressure in the Taslan nozzle 16 as well as the overfeed ratio of the rollers 15 and 17 was changed as shown by Runs 1 through 12 in Table 1.

An amount of water at the rate of 5 cc/min was added by means of the device 19 to the yarn.

A lubricant including mineral oil of more than 90 weight percent, having a Redwood viscosity of 70 sec. (when measured at a temperature of 30° C.) was supplied to the bulky yarn before it was wound onto a package by means of the take-up device 18. As a result, 2 weight percent of the lubricant could be retained on the wound yarn. The yarn was wound at an angle of wind of 15° onto a bobbin with an outer diameter of 80 mm under a tension of 25 g by means of the take-up device 18 to obtain straight packages which were 150 mm in width and 2 kg in weight.

The loop numbers, the slack numbers, and the degree of bulkiness before and after heat treatment in Runs 1 through 12 are shown in Table 1.

The packages obtained in each of the Runs 1 through 12 were supplied to an 18 gauge circular interlock knitting machine, having 24 yarn inlets. The knitting speed of this particular machine was 100 m/min. To monitor the knittability of the yarn, automatic devices were used on yarn passageway from creel to the needle of the knitting machine for stopping the operation of the knitting machine, when the tension of any one of the yarns was increased until it was larger than 70 g or when any one of the yarns was broken.

The number of times when the knitting machine stopped during the production of a 48 kg fabric was manually counted for each of the Runs 1 through 12.

Table 1

| Run No. | Operating Conditions: Overfeed ratio (%) | Air pressure in nozzle 16 (kg/cm²) | Interlacing device 14 | Results 1 (Bulky Yarn): Loop Number (N./m) | Slack number (N./m) | Degree of Bulkiness (cc/g): Before heat treatment | After heat treatment | Results 2 (Knitting Process): Number of stops of knitting machine (N./kg) | Touch of fabrics |
|---|---|---|---|---|---|---|---|---|---|
| 1 | 25 | 2.0 | yes | 3380 | 1.6 | 6.8 | 17 | 1.77 | — |
| 2 | 25 | 2.5 | " | 3950 | 1.0 | 7.0 | 17 | 1.32 | — |
| 3 | 25 | 2.8 | " | 5220 | 0.83 | 9.2 | 19 | 0.65 | — |
| 4 | 25 | 3.0 | " | 6430 | 0.75 | 10 | 19 | 0.46 | good |
| 5 | 25 | 4.0 | " | 7890 | 0.50 | 12 | 21 | 0.38 | " |
| 6 | 25 | 5.0 | " | 9840 | 0.41 | 13 | 21 | 0.30 | " |
| 7 | 25 | 6.0 | " | 11010 | 0.33 | 14 | 22 | 0.28 | " |
| 8 | 8 | 4.0 | " | 2880 | 0.58 | 5.7 | 13 | 0.30 | poor |
| 9 | 10 | 4.0 | " | 3040 | 0.50 | 6.4 | 15 | 0.28 | good |
| 10 | 13 | 4.0 | " | 4060 | 0.46 | 8.1 | 18 | 0.25 | " |
| 11 | 25 | 4.0 | No | 7400 | 2.6 | 13 | 22 | 2.30 | — |
| 12 | 10 | 4.0 | No | 2850 | 2.0 | 6.0 | 13 | 1.92 | — |

From the view point of knittability, the frequency of machine stops should be kept below 0.5 number/1 kg. In Comparative Runs 1 through 3 wherein the numbers of slacks are larger than 0.8, the frequency of knitting machine stops for each run is higher than the allowable limit, that is, 0.5 number/1 kg.

The obtained fabrics in each of the Runs 3 through 10 were first subjected to a dyeing process and then to dry heating at a temperature of 180° C. The handling (or touch) of such treated fabrics was respectively evaluated.

The dyed fabric obtained in Run 8 has a filament-like handling and therefore lacks bulkiness. The fabric obtained in Run 9 has a relatively decreased bulkiness. The decreased bulkiness, however, was within the range of a practical use. Fabrics obtained in Runs 4 through 7 and in Runs 9 and 10 have a spun-like soft handling and also exhibit an increased bulkiness.

Runs 11 and 12 are comparative runs indicating the effect of the interlacing device 14 shown in FIG. 1. In these runs, since the device 14 is not provided, the slack numbers are increased. As a result, the number of machine stops during the knitting process is greatly increased.

EXAMPLE 2

Each of the combined yarns was composed of (1) a multifilament drawn yarn $F_1$ made of polyethylene terephthalate having an intrinsic viscosity of 0.64 when measured in a solution of o-chlorophenol at a temperature of 25° C. and (2) a multifilament drawn yarn $F_2$ made of a modified copolymerized polyethylene terephthalate of 3 mol % sodium salt of 5-sulfoisophthalic acid, having an intrinsic viscosity of 0.58. The denier number and the number of the individual filaments of the yarns $F_1$ and $F_2$ as well as the weight ratios of $F_1$ to $F_2$ for Runs 13 through 17 are shown in Table 2. The combined yarns were directly supplied to station $S_2$ of the device shown in FIG. 2 under operating conditions substantially the same as those of Example 1, wherein the thermal shrinkage in boiling water of the yarns $F_1$ and $F_2$ were maintained within a range of between 11 and 12%, the overfeed ratio between the rollers 15 and 17 was 25%, and the pressure of the air in the Taslan nozzle 16 was 4.0 kg/cm².

The yarns thus obtained in Runs 13 through 17 were knitted to form circular knitting fabrics which were then subjected to a dyeing process using basic dyes.

The fabrics made of combined yarns wherein the weight ratio of the filament $F_1$ to the filament $F_2$ was maintained between 1:4 and 4:1 exhibited good heather effects.

Table 2

| Run No. | Types of Combined Yarns: $F_1$ denier-number of filaments | $F_2$ denier-number of filaments | Weight of $F_1$ to Weight of $F_2$ | Results 1: Slack number (N./m) | Loop number (N./m) | Degree of Bulkiness(cc/g): Before heat treatment | After heat treatment | Results 2: Heather effect after dyeing |
|---|---|---|---|---|---|---|---|---|
| 13 | 119-38 | 31-10 | 3.8:1.0 | 0.45 | 6500 | 12 | 20 | average good * 1 |
| 14 | 111-36 | 39-12 | 2.8:1.0 | 0.42 | 6480 | 12 | 22 | good |
| 15 | 75-24 | 75-24 | 1.0:1.0 | 0.40 | 6520 | 12 | 24 | very good |
| 16 | 39-12 | 111-36 | 1.0:2.8 | 0.45 | 6510 | 12 | 23 | good |
| 17 | 31-10 | 119-38 | 1.0:3.8 | 0.46 | 6480 | 12 | 23 | average good * 2 |

* 1 This dyed fabric exhibits relatively large white (or undyed) portions.
* 2 This dyed fabric exhibits relatively large colored (or dyed) portions.

EXAMPLE 3

Two types of drawn yarns, shown in the Table 3, made of polyester (polyethylene terephthalate) polymers having a shrinkage of 13% in boiling water were treated by means of the device shown in FIG. 2 under operating conditions substantially the same as the conditions of Example 2. In order to maintain stable loop shapes in the bukly yarn by means of tension applied to the yarn during a subsequent process, such as rewinding, knitting or weaving, the degree of loop stability should preferably be larger than 0.5 g/denier, more preferably, larger than 0.8 g/denier. In order to maintain the loop stability larger than 0.8 g/denier, the denier number of one individual filament ($F_4$), when yarns $F_3$ and $F_4$ of a different denier are combined together, should be lower than 2.3 denier, more preferably, lower than 2.2 denier.

Table 3

| Run No. | Type of Combined Yarns: $F_3$ (denier number of a individual filament) | $F_4$ (denier number of a individual filament) | ratio of the number of filaments in $F_4$ to that in $F_3 + F_4$ | slack number (N./m) | loop number (N./m) | Degree of Bulkiness (cc/g): Before heat treatment | After heat treatment | Loop stability (g/d) |
|---|---|---|---|---|---|---|---|---|
| 18 | 75d-24f (3.13d) | 75d-72f (1.04d) | 75 (%) | 0.32 | 8210 | 13 | 23 | 1.88 |
| 19 | " | 75d-36f (2.08d) | 60 | 0.40 | 5340 | 13 | 22 | 1.01 |
| 20 | 100d-24f (4.17d) | 50d-48f (1.04d) | 67 | 0.36 | 6850 | 12 | 22 | 1.40 |

The bulky yarns obtained in Runs 18, 19 and 20 were supplied to an 18-gauge circular knitting machine to produce fabrics which were subsequently subjected to a dyeing process. The fabric, obtained a Runs 18 and 20 exhibited superior bulkiness and softness as well as a soft and spun-like handling. The fabric obtained in Run 19 also exhibited a good bulkiness and softness, which, however, was not as good as that of the fabric obtained in Runs 18 and 20.

EXAMPLE 4

Two types of polyester (polyethylene terephthalate) multifilament yarns (75D-36F) with different shrinkage in boiling water as shown in Runs 21 through 23 of Table 4 were subjected to the process of the invention using the device shown in FIG. 2, wherein the peripheral speeds of the rollers 12 and 15 were 440 m/min and 400 m/min, respectively; the diameter of the heated pin 13 was 55 mm; the air pressure in the interlacing device 14 and in the Taslan nozzle 16 were 6 kg/cm$^2$ and 8 kg/cm$^2$, respectively; the overfeed ratio of the rollers 15 and 17 were 30%, and the tension for winding a yarn onto package was 20 g. Other operating conditions remained substantially the same as those of Example 2. The properties of the yarns obtained in Runs 21 through 23 are shown in Table 4, below.

Table 4

| Run No. | Types of Yarn Combinations: Shrinkage in Boiling water of Yarn $F_5$ (%) | Shrinkage in Boiling water of Yarn $F_6$ (%) | Difference of Shrinkage* | Results: Degree of Bulkiness (cc/g): Before heat treatment | After heat treatment | Slack Number (N./m) | Loop Number (N./m) |
|---|---|---|---|---|---|---|---|
| 21 | 18 | 7 | 11 | 11 | 25 | 0.31 | 6300 |
| 22 | 15 | 7 | 8 | 11 | 23 | 0.33 | 6320 |
| 23 | 10 | 7 | 3 | 11 | 20 | 0.37 | 6340 |

*The difference between the shrinkage of $F_5$ and the shrinkage of $F_6$.

When the difference of the shrinkage in boiling water is maintained so that it is larger than 3% the fabrics from the combined bulky yarns exhibit superior bulkiness.

EXAMPLE 5

Drawn yarns of polyethylene-terephthalate having a shrinkage of 12% in boiling water were treated by means of the device shown in FIG. 2 for obtaining soft yarn packages, wherein the overfeed ratio of the roller 15 to the roller 17 was 40% and the pressure of the air in the Taslan nozzle 16 was 5 kg/cm$^2$. The winding tension of the yarns by the take-up device 18 for forming soft packages of 2 kg in weight was selected for Runs 24 through 26 as shown in Table 5. Other operating conditions were substantially the same as those of Example 1. The properties of the yarns in each of the Runs 24 through 26 are shown in the section labeled Results 1 of Table 5.

The bobbins of soft packages obtained in Runs 24 through 26 were replaced by perforated tube with an outer diameter of 75 mm, and then subjected to a conventional package dyeing process. The dyed packages after being subjected to a conventional after-oiling process were rewound onto cone-shaped packages during which an amount of lubricant (so-called "coning oil") with a Redwood viscosity of 70 sec. was additionally supplied to the rewound yarn. The properties of the cone-shaped packages of yarn, are shown in the section labeled Results 3 of Table 5.

The cone-shaped packages were further subjected to a knitting process for producing knitting fabrics. The properties of the produced fabrics are also shown in Table 5.

Table 5

| | RUN NO. | 24 | 25 | 26 |
|---|---|---|---|---|
| Operating Conditions | winding tension (g/denier) *0 | 0.05 | 0.07 | 0.08 |
| Results 1 (Bulky Yarn) | density of package (g/cc) | 0.24 | 0.26 | 0.27 |
| | denier of the yarn (D) | 193 | 191 | 189 |
| | degree of bulkiness before heat treatment (cc/g) | 15 | 14 | 14 |
| | degree of bulkiness after heat treatment (cc/g) | 26 | 25 | 25 |
| | slack number (N./m) | 0.65 | 0.62 | 0.59 |

Table 5-continued

| | RUN NO. | 24 | 25 | 26 |
|---|---|---|---|---|
| | loop number (N./m) | 9900 | 9570 | 9130 |
| Results 2 (Dyed Packages) | degree of bulkiness | | | |
| | (innermost layer *1 (cc/g)) | 15 | 15 | 14 |
| | (outermost layer *2 (cc/g)) | 14 | 13 | 12 |
| | difference in color between the innermost and outermost layers *3 | None | None | None |
| Results 3 (cone-forming) | tension difference during rewinding *4 | None | Medium | Medium |
| | number of breakages *5 (N./kg) | 0.2 | 0.4 | 0.5 |
| | amount of lost yarns (%) | 0.5 | 0.4 | 0.5 |
| Results 4 (Knitting) | appearances of fabrics | good | good | good |

Notes:
*0 Measured at a position before the position of take-up device 18.
*1 Bulk factor of dyed soft packages in the innermost layers thereof was measured by using equation (2), stated hereinabove.
*2 Bulk factor in the outermost layers was measured in the same manner as that stated in *1.
*3 Difference in color between the innermost portion of the dyed package and the outermost portion of the dyed package was examined.
*4 During formation of the cone-shaped package the difference between the tension occurring outermost portion of the dyed package was removed and tension occurring when the innermost portion of the dyed package was removed was examined.
*5 The average number of yarn end breakages was measured during production of 10 kg cone-shaped packages from dyed packages.

As is clear from Table 5, when the winding tension is kept below a predetermined limit, the bulky yarn can be easily removed from the dyed package. In addition to good yarn removal from dyed package and knittability, uniformity of color and appearances is kept in the produced fabrics.

EXAMPLE 6

Operating conditions for Example 6 were substantially the same as those in Example 5, except that the overfeed ratio of the rollers 15 and 16 was 20%, and the tension occurring during formation of soft packages by the take-up device 18 was changed for Runs 27 and 28 as shown in Table 6. The soft packages were subjected to a dyeing process, which dyed packages were rewound onto the cone-shaped. Such cone-shaped packages were supplied to a knitting machine for producing fabrics. The results of Example 6 are shown in Table 6.

Table 6

| | RUN NO. | 27 | 28 |
|---|---|---|---|
| Operating Conditions | winding-up tension (g/denier) | 0.05 | 0.06 |
| Results 1 (Bulky Yarn) | density of package (g/cc) | 0.28 | 0.30 |
| | denier number of yarn D | 175 | 173 |
| | degree of bulkiness before heat treatment (cc/g) | 14 | 14 |
| | degree of bulkiness after heat treatment (cc/g) | 22 | 21 |
| | slack number (N./m) | 0.47 | 0.45 |
| | loop number (N./m) | 6210 | 6080 |
| Results 2 (Dyed Packages) | degree of bulkiness | | |
| | (innermost layer (cc/g)) | 15 | 15 |
| | (outermost layer (cc/g)) | 14 | 13 |
| | difference in color between the innermost and outermost layers | None | None |
| Results 3 (Cone-forming) | tension difference during cone shaping | small | small |
| | number of breakages (N./kg) | 0.1 | 0.3 |
| | amount of lost yarns (%) | 0.6 | 1.2 |
| Results 4 (Knitting) | appearance of fabrics | good | slightly non-uniformly dyed* |

*Non-uniformity of the dyed color was within a range of practical use.

When the density of the bulky yarn package was kept below a predetermined limit, a difference in color did not occur substantially between the innermost and the outermost layers of the soft package after it was subjected to a dyeing process. Therefore, a uniformly dyed knit fabric was obtained.

What is claimed is:

1. A thermoplastic multifilament bulky yarn comprised of a plurality of individual filaments, wherein each of said filaments has a randomly varying thermal shrinkage along the length thereof, said filaments having randomly varying thermal shrinkage across the cross-section of the yarn, the number of loops which project from the surface of the bundle of the filaments being greater than 3000 per meter, and the number of filament slack portions which project from the surface of the bundle of filaments and which have a maximum spacing from the surface which is greater than 2.5 mm, is less than 0.8 slack portions per meter.

2. A bulky yarn according to claim 1, wherein the difference between the degree of bulkiness of the yarn before heat treatment and the degree of bulkiness of the yarn after heat treatment is greater than 5 cc/g.

3. A bulky yarn according to claim 1, wherein the multifilament yarn is composed of a polyester polymer.

4. A bulky yarn according to claim 1, wherein each of the individual filaments of the multifilament yarn has a denier less than 3.2.

5. A bulky yarn according to claim 1, wherein the multifilament yarn comprises a mixture of filaments of at least two types, one such type including fine denier individual filaments having deniers less than 2.2, and another such type including heavy individual filaments having deniers greater than 3.0, and wherein the number of fine denier filaments is greater than one-half of the total number of filaments forming the yarn.

6. A bulky yarn according to claim 1, wherein the multifilament yarn comprises a mixture of filaments of at least two types, one such type including individual filaments of a polyester material having no affinity for ionic dyes and another such type including individual filaments of another polyester material having an affinity for ionic dyes, and wherein the weight ratio of the first type to the second type is within the range from 1:4 to 4:1.

* * * * *

UNITED STATES PATENT AND TRADEMARK OFFICE

CERTIFICATE OF CORRECTION

PATENT NO. : 4,167,847

DATED : September 18, 1979

INVENTOR(S) : Hajime Arai et al

It is certified that error appears in the above-identified patent and that said Letters Patent are hereby corrected as shown below:

In the Abstract, line 16, "condition" should read "rate".

Col. 2, line 27 "onto" should be placed after "yarn".

Col. 3, line 6, "perimeter" should read "per meter".

Col. 7, line 15, "(not shown)" should be deleted.

Col. 7, line 16, after "hank", "(not shown)" should be added.

Signed and Sealed this

*Eleventh* Day of *March 1980*

[SEAL]

*Attest:*

SIDNEY A. DIAMOND

*Attesting Officer*

*Commissioner of Patents and Trademarks*